US010913907B2

(12) United States Patent
Raja et al.

(10) Patent No.: US 10,913,907 B2
(45) Date of Patent: Feb. 9, 2021

(54) PROCESS FOR CONVERSION OF HYDROCARBONS TO MAXIMISE DISTILLATES

(71) Applicant: HINDUSTAN PETROLEUM CORPORATION LIMITED, Mumbai (IN)

(72) Inventors: Kanuparthy Naga Raja, Hoskote Bangalore (IN); Pudi Satyanarayana Murty, Hoskote Bangalore (IN); Bhavesh Sharma, Hoskote Bangalore (IN); Peddy Venkata Chalapathi Rao, Hoskote Bangalore (IN); Nettem Venkateswarlu Choudary, Hoskote Bangalore (IN); Sriganesh Gandham, Hoskote Bangalore (IN)

(73) Assignee: Hindustan Petroleum Corporation Limited, Mumbai (IN)

( * ) Notice: Subject to any disclaimer, the term of this patent is extended or adjusted under 35 U.S.C. 154(b) by 0 days.

(21) Appl. No.: 16/335,289

(22) PCT Filed: Sep. 20, 2017

(86) PCT No.: PCT/IB2017/055691
§ 371 (c)(1),
(2) Date: Mar. 21, 2019

(87) PCT Pub. No.: WO2018/055520
PCT Pub. Date: Mar. 29, 2018

(65) Prior Publication Data

US 2019/0211276 A1 Jul. 11, 2019

(30) Foreign Application Priority Data

Sep. 21, 2016 (IN) ..... 201621032243

(51) Int. Cl.
*C10G 65/10* (2006.01)
*C10G 1/00* (2006.01)
*C10G 67/02* (2006.01)

(52) U.S. Cl.
CPC ..... *C10G 65/10* (2013.01); *C10G 1/002* (2013.01); *C10G 67/02* (2013.01);
(Continued)

(58) Field of Classification Search
CPC ..... C10G 47/24–30; C10G 65/10
See application file for complete search history.

(56) References Cited

U.S. PATENT DOCUMENTS 3,437,588 A 4/1969 Kovach et al.
3,847,795 A 11/1974 Rieve et al.
(Continued)

OTHER PUBLICATIONS

Castano, Laura Cristina Uran, "Coke Formation During Thermal Cracking of a Heavy Crude Oil", p. 19, 2015.*
(Continued)

*Primary Examiner* — Renee Robinson
(74) *Attorney, Agent, or Firm* — Sand, Sebolt & Wernow Co., LPA

(57) ABSTRACT

The present disclosure relates to a process for hydro-processing of hydrocarbons to maximize the yield of light distillates. The process comprises hydrocracking hydrocarbons and separating to respective products based on the boiling points. The heavier vacuum residue is further hydrocracked to light distillates.

6 Claims, 1 Drawing Sheet

(52) U.S. Cl.
CPC ..... *C10G 2300/1033* (2013.01); *C10G 2300/206* (2013.01); *C10G 2300/301* (2013.01); *C10G 2400/04* (2013.01); *C10G 2400/08* (2013.01)

(56) References Cited

U.S. PATENT DOCUMENTS

| | | | | |
|---|---|---|---|---|
| 4,082,647 | A | 4/1978 | Hutchings et al. | |
| 2015/0021233 | A1* | 1/2015 | Sundararaman ..... | C10G 45/16 208/49 |

OTHER PUBLICATIONS

Navarro, Lina et al, "Separacion y Caracterizacion de Resinas y Aslfaltenos Provenientes del Crudo Castilla. Evaluacion de su Interaccion Molecular", Ciencia, Tecnologia y Futuro, p. 56, Dec. 2004.*

* cited by examiner

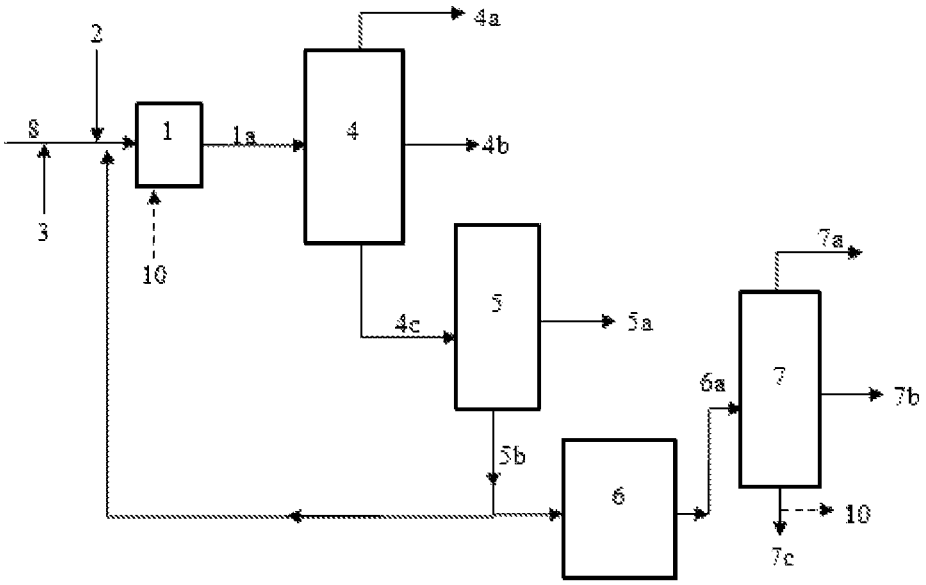
2
8
3
1
10
1a
4
4a
4b
4c
5
5a
5b
6
6a
7
7a
7b
7c
10

PROCESS FOR CONVERSION OF HYDROCARBONS TO MAXIMISE DISTILLATES

FIELD

The present disclosure relates to an integrated process for hydrocracking crude oil to produce higher yields of light distillates.

DEFINITIONS

As used in the present disclosure, the following terms is generally intended to have the meaning as set forth below, except to the extent that the context in which they are used indicate otherwise.

SIMDIST refers to simulated distillation which is a gas chromatography (GC) based method for the characterization of petroleum products.

ASTM D-7169 is a test that determines the boiling point distribution and cut point intervals of the crude oil and residues using high temperature gas chromatography.

Light distillates are distillate fractions comprising hydrocarbons with boiling points less than or equal to 370° C.

Basrah crude oil refers to crude oil obtained from Iraq.

Castilla crude oil refers to crude oil obtained from South America.

BACKGROUND

Conventionally, in petroleum refineries, distillation units are used for transforming crude oil into valuable fuel products having different boiling fractions. These straight run products are separated and treated by using different processes in order to meet the product quality that can be marketed. In the conventional process, the conversion of crude oil can be increased by increasing the number of process units such as distillation columns. However, this increases the complexity of the entire process.

The global demand for light distillates is growing exponentially. In order to maximize the yield of such distillates, hydrocracking process is used to convert heavy hydrocarbons into more valuable distillates under hydrogen atmosphere. Hydro-processing or hydrocracking is particularly carried out at the downstream of process units such as distillation columns, after crude oil is separated into straight run products. In hydro-processing, hydrocarbons including naphtha, gas oils, and cycle oils are treated to remove sulfur and nitrogen content from the hydrocarbons or reformed to obtain light hydrocarbons with increased octane number.

Conventionally, in refineries, crude oil is separated into various fractions which are further converted in other downstream processes, thereby increasing the consumption of energy requirement and making the entire process non-economical. Moreover, due to the stringent environmental norms, focus is given to hydro-processing technologies so as to obtain products with reduced consumption of energy.

Asphaltenes present in heavy oil/crude oil pose a threat to the downstream processing units owing to their potential of forming sediments and acting as coke precursors. These have a detrimental effect on the performance of the processing units, thereby reducing their efficiency and increasing the downtime in the worst scenarios.

Further, the olefins produced in a standalone refinery complex are minimal. For a petrochemical plant, the olefins production is essential and they are produced through steam cracking of feeds like Naphtha. This increases the plant complexity and capital cost.

There is, therefore, felt a need for a process that addresses the above issues and increases the yield of valuable petroleum fractions.

OBJECTS

Some of the objects of the present disclosure, which at least one embodiment herein satisfies, are as follows:

It is an object of the present disclosure to ameliorate one or more problems of the prior art or to at least provide a useful alternative.

Another object of the present disclosure is to provide a process for hydro-processing of hydrocarbons to obtain high yields of light distillates.

Still another object of the present disclosure is to reduce the amount of asphaltenes in the heavy hydrocarbons.

Still another object of the present disclosure is to provide an integrated process which is simple and economical.

Other objects and advantages of the present disclosure will be more apparent from the following description, which is not intended to limit the scope of the present disclosure.

SUMMARY

The present disclosure provides a process for conversion of hydrocarbons to light distillates. The process comprises hydrocracking the hydrocarbons, in the presence of hydrogen and a first catalyst, at a temperature in the range of 300° C. to 500° C., preferably in the range of 320 to 480° C. and at a pressure in the range of 2 to 80 bar, preferably in the range of 15 bar to 50 bar, to obtain a first hydrocracked stream. The first hydrocracked stream is fractionated to obtain a first top product stream having boiling point less than or equal to 180° C., a middle fraction having boiling point above 180° C. and below or equal to 370° C. and a bottom fraction having boiling point above 370° C. The bottom fraction is fractionated to obtain vacuum gas oil having boiling point equal to or above 370° C. and below 540° C. and vacuum residue having boiling point equal to or above 540° C.

A first portion of the vacuum residue, obtained in the process step of fractionation of bottom fraction, is hydrocracked in the presence of hydrogen and a second catalyst, at a temperature in the range of 300° C. to 500° C., preferably in the range of 320 to 480° C. and at a pressure in the range of 2 to 250 bar, preferably in the range of 2 bar to 150 bar, to obtain a second hydrocracked stream. A second portion of the vacuum residue is recycled to the process step of hydrocracking of hydrocarbons (in the first process step). The second hydrocracked stream is fractionated to obtain a second top product stream containing hydrocarbon fractions having boiling point less than or equal to 180° C., a second stream containing hydrocarbon fractions having boiling point above 180° C. and below or equal to 370° C. and a third stream containing hydrocarbon fractions having boiling point above 370° C. The overall yield of the hydrocarbons with boiling point less than or equal to 370° C. is in the range of 50% to 80%.

The hydrocarbons are selected from the group consisting of crude oil, tar sands, bituminous oil, bitumen oil sands and shale oil.

The first catalyst and the second catalyst comprise at least one metal or compounds of metals individually selected from the group consisting of chromium, manganese, iron, cobalt, nickel, zirconium, niobium, molybdenum, tungsten, ruthenium, rhodium, tin, and tantalum.

The amount of the first catalyst is in the range of 0.001 wt % to 10 wt % of the hydrocarbons; and the amount of the second catalyst is in the range of 0.01 wt % to 10 wt % of the hydrocarbons.

The process step of hydrocracking the hydrocarbons is carried out for a time period in the range of 15 minutes to 4 hours. The process step of hydrocracking the first portion of the vacuum residue is carried out for a time period in the range of 30 minutes to 6 hours.

The amount of the hydrogen in the first top product stream is in the range of 0.2 to 17 wt % of the fresh feed charged.

The process further comprises separating the hydrogen produced in the first top product stream and recycling the hydrogen to the process step of hydrocracking of hydrocarbons.

The process further comprises fractionating the third stream and separating a fraction having boiling point above 440° C. from the third stream. The separated fraction having boiling point above 440° C. is introduced to the process step of hydrocracking of hydrocarbons.

The amount of the separated fraction having boiling point above 440° C. being recycled to the first process step of hydrocracking does not exceed 50 wt % of fresh feed.

The first hydrocracked stream obtained in the first process step of hydrocracking the hydrocarbons has substantially reduced amount of asphaltenes.

The percentage of reduction in the asphaltene content in the first hydrocracked stream is in the range of 60 to 98%.

BRIEF DESCRIPTION OF THE ACCOMPANYING DRAWING

A process for conversion of hydrocarbons to distillates will now be described with the help of the accompanying drawing, in which:

FIG. 1 depicts a flow-diagram for conversion of hydrocarbons to distillates in accordance with the present disclosure.

| List of Reference Numerals | |
|---|---|
| FIRST HYDROCRACKER | 1 |
| FIRST HYDROCRACKED STREAM | 1a |
| FIRST CATALYST | 2 |
| HYDROGEN | 3 |
| FIRST FRACTIONATOR | 4 |
| FIRST TOP PRODUCT STREAM | 4a |
| MIDDLE FRACTION | 4b |
| BOTTOM FRACTION | 4c |
| SECOND FRACTIONATOR | 5 |
| VACUUM GAS OIL | 5a |
| VACUUM RESIDUE | 5b |
| SECOND HYDROCRACKER | 6 |
| SECOND HYDROCRACKED STREAM | 6a |
| THIRD FRACTIONATOR | 7 |
| SECOND TOP PRODUCT STREAM | 7a |
| SECOND STREAM | 7b |
| THIRD STREAM | 7c |
| HYDROCARBONS | 8 |
| SEPARATED FRACTION | 10 |

DETAILED DESCRIPTION

Conventionally, in refineries, crude oil is processed in crude oil distillation units (CDUs) to obtain a wide range of hydrocarbon products. However, these processes are complex, and the products obtained from the conventional processes require further purification/conversion steps. Moreover, the presence of asphaltenes in crude oil or heavy oil is disadvantageous to the performance of downstream processing units because of their potential for coke and sediment formation. A reduction in amount of asphaltenes is desired for smooth operation of the processing units.

The present disclosure, therefore, envisages a process for conversion of hydrocarbons to obtain light distillates that overcomes the above mentioned drawbacks.

The process is described herein below with reference to a flow-diagram as shown in FIG. 1.

Hydrocarbons (8) are hydrocracked in a first hydrocracker (1), in the presence of hydrogen (3) and a first catalyst (2), at a temperature in the range of 300° C. to 500° C., preferably in the range of 320 to 480° C. and at a pressure in the range of 2 to 80 bar, preferably in the range of 15 bar to 50 bar, to obtain a first hydrocracked stream (1*a*). In accordance with an embodiment of the present disclosure, silicone based antifoaming agents like polydimethylsiloxanes, corrosion inhibitors, bio-surfactants based on sulphonic acids, may be added to the hydrocarbons (8) before introducing it into the first hydrocracker (6). The process step of hydrocracking is carried out for a time period in the range of 15 minutes to 4 hours. In accordance with an embodiment of the present disclosure, the hydrocarbons (8) are preheated in a preheating zone at a temperature below 350° C., before introducing the hydrocarbons (8) to the first hydrocracker (1).

The first hydrocracked stream (1*a*) obtained in the process step of hydrocracking has substantially reduced amount of asphaltenes. In an embodiment, The percentage of reduction in the asphaltene content in the first hydrocracked stream (1*a*) is in the range of 60 to 98%.

The hydrocarbons (8) are selected from the group consisting of crude oil, tar sands, bituminous oil, bitumen oil sands and shale oil.

In accordance with an embodiment of the present disclosure, the API (American Petroleum Institute) gravity of the hydrocarbons (8) used for conversion is in the range of 7°-50°, preferably in the range of 10°-40°. The sulphur content of the hydrocarbons (8) is in the range of 0.05-5 wt %, preferably in the range of 0.1-3.5 wt %. The nitrogen content of the hydrocarbons (8) is in the range of 0.1-1 wt %, preferably in the range of 0.2-0.5 wt %. Total acid number (TAN) of the hydrocarbons (8) is in the range of 0.01-0.1 mg KOH/g, preferably in the range of 0.12-0.5 mg KOH/g. The water content of the hydrocarbons (8) is less than 1.5 wt %, preferably less than 0.1 wt % and the conradson carbon residue (CCR) of the hydrocarbons (8) is in the range of 1-30%, preferably in the range of 1-20 wt %.

The first catalyst (2) is in at least one form selected from the group consisting of colloidal dispersed catalyst, slurry phase dispersed catalyst, oil soluble catalyst and hydroprocessing catalyst. The first catalyst (2) comprises at least one metal or compounds of metals individually selected from the group consisting of chromium, manganese, iron, cobalt, nickel, zirconium, niobium, molybdenum, tungsten, ruthenium, rhodium, tin, and tantalum. The amount of the first catalyst (2) is in the range of 0.001 wt % to 10 wt % of the hydrocarbons (8).

The first hydrocracker (1) is at least one selected from the group consisting of a continuous stirred tank reactor (CSTR), a fixed bed reactor, a bubble column reactor, an ebullated bed reactor or combinations thereof. In accordance with an embodiment of the present disclosure, the first hydrocracker (1) comprises reactors in at least configuration selected from the group consisting of series, parallel and series-parallel.

The first hydrocracked stream (1*a*) is introduced into a first fractionator (4), wherein the first hydrocracked stream (1*a*) is fractionated to obtain a first top product stream (4*a*) having boiling point less than or equal to 180° C., a middle fraction (4*b*) having boiling point above 180° C. and below or equal to 370° C. and a bottom fraction (4*c*) having boiling point above 370° C.

The first top product stream (4*a*) includes produced hydrogen, dry gas, liquefied petroleum gas (LPG) and naphtha. The hydrogen is separated from the first top product stream (4*a*) and is purified and introduced into the first hydrocracker (1). In accordance with an embodiment of the present disclosure, the amount of the hydrogen produced in the first top product stream is in the range of 0.2 to 17 wt % of the fresh feed charged. The hydrogen produced is recycled to the first process step of hydrocracking. Olefins are also produced in the process step of hydrocracking wherein the olefins have carbon atoms in the range of $C_2$ to $C_5$.

In accordance with the present disclosure, naphtha is sent to hydrogenation unit or Isomerization unit or to Catalytic reforming unit. The middle fraction (4*b*) includes kerosene and diesel which can be sent to downstream processing units for further removal of impurities including heteroatoms such as sulphur, nitrogen, and the like. In accordance with an embodiment of the present disclosure, the first fractionator (4) is at least one atmospheric fractionation column.

The bottom fraction (4*c*) is fed to a second fractionator (5), wherein the bottom fraction (4*c*) is fractionated to obtain vacuum gas oil (5*a*) having boiling point above 370° C. and below 540° C. and vacuum residue (5*b*) having boiling point equal to or above 540° C. In accordance with the present disclosure, the vacuum gas oil (VGO) is introduced to at least one process unit selected from the group consisting of fluid catalytic cracking unit (FCCU), VGO hydrotreater, VGO hydrocracker and lube processing units, for further conversion or treatment. In accordance with an embodiment of the present disclosure, the second fractionator (5) is at least one vacuum fractionation column.

A first portion of the vacuum residue (5*b*) obtained in the above process step is hydrocracked in a second hydrocracker (6), in the presence of hydrogen and a second catalyst, at a temperature in the range of 300° C. to 500° C., preferably in the range of 320° C. to 480° C. and at a pressure in the range of 2 bar to 250 bar, preferably in the range of 2 to 150 bar to obtain a second hydrocracked stream (6*a*). In accordance with an embodiment of the present disclosure, silicone based antifoaming agents like polydimethylsiloxanes, corrosion inhibitors, bio-surfactants based on sulphonic acids, may be added to the first portion of vacuum residue (5*b*), before introducing the first portion of the vacuum residue (5*b*) into the second hydrocracker (6). The process step of hydrocracking is carried out for a time period in the range of 30 minutes to 6 hours.

The second catalyst is in at least one form selected from the group consisting of colloidal dispersed catalyst, slurry phase dispersed catalyst, oil soluble catalyst and hydroprocessing catalyst. The second catalyst comprises at least one metal or metallic compounds of metals selected from the group consisting of chromium, manganese, iron, cobalt, nickel, zirconium, niobium, molybdenum, tungsten, ruthenium, rhodium, tin, and tantalum. The amount of the second catalyst is in the range of 0.01 wt % to 10 wt % of the feed charged (8). Further, a second portion of the vacuum residue (5*b*) is recycled to the first hydrocracker (1).

The second hydrocracked stream (6*a*) is fed to a third fractionator (7), wherein the second hydrocracked stream (6*a*) is fractionated to obtain a second top product stream (7*a*) containing hydrocarbon fractions having boiling point less than or equal to 180° C., a second stream (7*b*) containing hydrocarbon fractions having boiling point above 180° C. and below or equal to 370° C. and a third stream (7*c*) containing hydrocarbon fractions having boiling point above 370° C. The third stream (7*c*) is processed further in other processing units such as fluid catalytic cracking unit, VGO hydrocracker, delayed coker, visbreaker and bitumen blowing units. The second top product stream (7*a*) includes gases, LPG and naphtha and the second stream (7*b*) include kerosene and diesel. In accordance with the present disclosure, naphtha is either reformed in the presence of steam to generate hydrogen or isomerized. The second stream (7*b*) includes kerosene and diesel which is further sent to downstream processing units for further removal of impurities including heteroatoms such as sulphur, nitrogen, and the like. In accordance with an embodiment of the present disclosure, the third fractionator (7) is one of an atmospheric fractionation column. The third stream (7*c*) may be recycled to the first hydrocracker (1).

The process further comprises fractionating the third stream and separating a fraction (10) having boiling point above 440° C. from the third stream. The separated fraction (10) is recycled to the first hydrocracker (1). In accordance with an embodiment of the present disclosure, the amount of the separated fraction (10), recycled to the first hydrocracker, does not exceed 50 wt % of the fresh feed charged to the first hydrocracker (1).

The process of the present disclosure is capable of obtaining light hydrocarbons (light distillates) with increased yield by processing bottoms obtained from fractionators in hydrocrackers. In an embodiment, the overall yield of the hydrocarbons with boiling point less than or equal to 370° C. is in the range of 50% to 80%. Moreover, the process of the present disclosure is capable of obtaining hydrocarbons with reduced content of impurities including heteroatoms such as sulphur and nitrogen.

The present disclosure is further described in light of the following laboratory scale experiments which are set forth for illustration purpose only and not to be construed for limiting the scope of the disclosure. These laboratory scale experiments can be scaled up to industrial/commercial scale and the results obtained can be extrapolated to industrial/commercial scale.

EXPERIMENTAL DETAILS

Experiment 1: Hydrocracking of Crude Oil (Basrah Crude Oil)

An experimental hydrocracker (Batch reactor) was charged with 100 g of crude oil and catalyst slurry containing 1000 ppm molybdenum. The experimental hydrocracker was purged with nitrogen to remove any air present inside. After purging of nitrogen, the experimental hydrocracker was pressurized with hydrogen to 15 bar.

The crude oil was hydrocracked at 420° C. in the presence of hydrogen and the catalyst slurry under continuous stirring at 1000 rpm for 20 minutes to obtain a hydrocracked product stream.

The hydrocracked product stream was fed to an experimental atmospheric fractionation column, wherein various fractions were separated based on the boiling points, to obtain a top product stream having boiling point less than or equal to 180° C., a middle fraction having boiling point above 180° C. and below or equal to 370° C. and a bottom fraction having boiling point above 370° C. as per ASTM D86.

The bottom fraction was introduced into an experimental vacuum fractionation column as per ASTM D5236 to obtain vacuum gas oil having boiling point above 370° C. and less than 540° C. and vacuum residue having boiling point equal to or above 540° C.

A first portion of the vacuum residue was hydrocracked, in the presence of hydrogen and the catalyst slurry containing 10000 ppm molybdenum, at a temperature of 450° C. and at a pressure of 100 bar for 3 hours, to obtain a second hydrocracked stream.

The second hydrocracked stream was separated to different cut points as per ASTM D86 and ASTM D5236. The liquid products from the experimental fractionator were collected separately and were analyzed using GC-SIMDIST as per ASTM D-7169.

In order to determine the difference in the yields of light hydrocarbons without using the process steps of the present disclosure, the crude oil was directly introduced into an experimental atmospheric fractionation column. The crude oil was heated in the experimental atmospheric fractionation column and various fractions were separated based on the boiling points. The liquid products from the experimental atmospheric fractionation column were collected separately and were analyzed using GC-SIMDIST as per ASTM D-7169.

The difference in the yields of light hydrocarbons with or without using the process steps of the present disclosure is summarized in Table 1.

TABLE 1

Total yields of different fractions of hydrocracked crude oil

| Fractions obtained | Yield (conventional process) wt % | Yield (Process of the present disclosure), wt % | Difference in yield, wt % |
|---|---|---|---|
| ≤180° C. | 16.8 | 39.78 | +22.98 |
| >180° C. & ≤370° C. | 20.9 | 30.63 | +9.73 |
| >370° C. | 53.3 | 29.59 | −23.71 |

From Table-1, it is evident that the yield of light distillates (hydrocarbons with boiling points less than or equal to 370° C.) obtained by using the process of the present disclosure is greater than that obtained by using the conventional process. From Table-1, it is also observed that using the conventional process, the yield of the fractions having boiling point >180° C. & ≤370° C. is 30.63 wt % and the yield of the fractions having boiling point >370° C. is 29.59 wt %. However, by using the process step of the present disclosure, the yield of the fractions having boiling point less than or equal to 180° C. & between 180° C. and 370° C. is comparatively increased. This indicates that by using the process steps of the present disclosure, the yield of light distillatesis improved.

Experiment 2: Hydrocracking of Crude Oil (Castilla Crude Oil)

An experimental hydrocracker (Batch reactor) was charged with 100 g of crude oil and catalyst slurry containing 3000 ppm molybdenum. The experimental hydrocracker was purged with nitrogen to remove any air present inside. After purging of nitrogen, the experimental hydrocracker was pressurized with hydrogen to 15 bar.

The crude oil was hydrocracked at 450° C. in the presence of hydrogen and the catalyst slurry under continuous stirring at 1000 rpm for 20 minutes to obtain a hydrocracked product stream.

The hydrocracked product stream was fed to an experimental atmospheric fractionation column as per ASTM D86, wherein various fractions were separated based on the boiling points, to obtain a top product stream having boiling point less than or equal to 180° C., a middle fraction having boiling point above 180° C. and below or equal to 370° C. and a bottom fraction having boiling point above 370° C.

The bottom fraction was introduced into an experimental vacuum fractionation column ASTM D5236 to obtain vacuum gas oil having boiling point above 370° C. and less than 540° C. and vacuum residue having boiling point equal to or above 540° C.

A first portion of the vacuum residue was hydrocracked, in the presence of hydrogen and the catalyst slurry containing 10000 ppm molybdenum, at a temperature of 440° C. and at a pressure of 120 bar for 3 hours, to obtain a second hydrocracked stream.

The second hydrocracked stream was fed to another experimental atmospheric fractionation column as per ASTM D86. The liquid products from the experimental fractionator were collected separately and were analyzed using GC-SIMDIST as per ASTM D-7169.

In order to determine the difference in the yields of light hydrocarbons without using the process steps of the present disclosure, the crude oil was directly introduced into an experimental atmospheric fractionation column. The crude oil was heated in the experimental atmospheric fractionation column and various fractions were separated based on the boiling points. The liquid products from the experimental atmospheric fractionation column were collected separately and were analyzed using GC-SIMDIST as per ASTM D-7169.

The difference in the yields of light hydrocarbons with or without using the process steps of the present disclosure is summarized in Table 2.

TABLE 2

Total yields of different fractions of hydrocracked crude oil

| Fractions obtained | Yield (conventional process) wt % | Yield (process of the present disclosure), wt % | Difference in yield, wt % |
|---|---|---|---|
| ≤180° C. | 9 | 43.89 | +34.89 |
| >180° C. & ≤370° C. | 23.9 | 27.59 | +3.69 |
| >370° C. | 67.1 | 28.58 | −38.52 |

From Table-2, it is evident that the yield of light distillates (hydrocarbons with boiling points less than or equal to 370° C.) obtained by using the process steps of the present disclosure is greater than that obtained by using the conventional process. From Table-2, it is also observed that by using the conventional process, the yield of the fractions having boiling point >180° C. & ≤370° C. is 23.9 wt % and the yield of the fractions having boiling point >370° C. is 67.1 wt %. However, by using the process step of the present disclosure, the yield of the fractions having boiling point ≤80° C. & between 180° C. and 370° C. is comparatively increased. This indicates that by using the process steps of the present disclosure, the yield of light hydrocarbons is improved.

Experiment 3: Asphaltene Reduction Upon Hydrocracking of Crude Oil (Basrah Crude Oil)

An experimental hydrocracker (Batch reactor) was charged with 100 g of crude oil and catalyst slurry containing 3000 ppm molybdenum. The experimental hydrocracker was purged with nitrogen to remove any air present inside. After purging of nitrogen, the experimental hydrocracker was pressurized with hydrogen to 15 bar.

The crude oil was hydrocracked at 420° C. in the presence of hydrogen and the catalyst slurry under continuous stirring at 1000 rpm for 20 minutes to obtain a hydrocracked product stream.

The hydrocracked product stream was separated to different cut points as per ASTM D86 and ASTM D5236. The liquid products from the experimental fractionator were collected separately and were analyzed using GC-SIMDIST as per ASTM D-7169. The asphaltene content in the liquid and solid products was analyzed using method IP469.

The raw crude oil was also analyzed using IP-469 to assess the asphalthene content in it.

The difference in the asphaltene content of raw crude and the hydrocracked crude using the process step of the present disclosure is summarized in Table 3.

TABLE 3

| Reduction in Asphaltene content in the hydrocracked stream | | |
|---|---|---|
| Asphaltenes in Raw Crude, wt % | Asphaltenes in hydrocracked Crude, wt % | Reduction in asphaltenes |
| 14.40 | 2.4 | 83.33% |

From Table-3, it is evident that there is a significant reduction of asphaltenes by hydrocracking crude oil in the first hydrocracker. The reduction of asphaltenes is beneficial because they are a potential cause of formation of sediments and coke precursors. By reducing the asphaltenes in the first step, the problems associated with it are eliminated or reduced significantly when the products are further processed in the downstream units.

Technical Advances and Economical Significance

The present disclosure described herein above has several technical advantages including, but not limited to, the realization of a process that is capable of:

- obtaining light hydrocarbons with increased yields;
- increasing the conversion of heavy hydrocarbons to light hydrocarbons (light distillates);
- producing hydrogen and olefins in the process;
- hydrocracking the hydrocarbons before separation or fractionation steps to increase the overall efficiency of the refinery;
- reducing the asphaltene content in the heavy hydrocarbons which would otherwise lead to fouling the downstream process units; and
- being simple and economical.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results. While certain embodiments of the inventions have been described, these embodiments have been presented by way of example only, and are not intended to limit the scope of the inventions. Variations or modifications to the formulation of this invention, within the scope of the invention, may occur to those skilled in the art upon reviewing the disclosure herein. Such variations or modifications are well within the spirit of this invention.

The numerical values given for various physical parameters, dimensions and quantities are only approximate values and it is envisaged that the values higher than the numerical value assigned to the physical parameters, dimensions and quantities fall within the scope of the invention unless there is a statement in the specification to the contrary.

While considerable emphasis has been placed herein on the specific features of the preferred embodiment, it will be appreciated that many additional features can be added and that many changes can be made in the preferred embodiment without departing from the principles of the disclosure. These and other changes in the preferred embodiment of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A process for conversion of hydrocarbons to light distillates, said process comprising the following steps:

i. hydrocracking crude oil containing hydrocarbons with an API gravity in the range of 10°-40°, in the presence of hydrogen and a first catalyst, at a temperature in the range of 300° C. to 500° C., and at a pressure in the range of 2 bar to 80 bar, to obtain a first hydrocracked stream;
   - wherein the hydrocracking is carried out for a time period in the range of 15 minutes to 4 hours;
   - wherein said first hydrocracked stream has a substantially reduced amount of asphaltenes;
   - and wherein the percentage of reduction in the asphaltene content in the first hydrocracked stream is in the range of 60% to 98% ii. fractionating said first hydrocracked stream to obtain a first top product stream having boiling point less than or equal to 180° C., a middle fraction having boiling point above 180° C. and below or equal to 370° C. and a bottom fraction having boiling point above 370° C.;

iii. fractionating said bottom fraction to obtain vacuum gas oil having boiling point above 370° C. and less than 540° C. and vacuum residue having boiling point equal to or above 540° C.;

iv. hydrocracking a first portion of said vacuum residue obtained in the process step (iii), in the presence of hydrogen and a second catalyst, at a temperature in the range of 300° C. to 500° C., and at a pressure in the range of 2 bar to 250 bar, to obtain a second hydrocracked stream;

v. recycling a second portion of said vacuum residue to the process step (i); and vi. fractionating said second hydrocracked stream to obtain a second top product stream containing hydrocarbon fractions having boiling point less than or equal to 180° C., a second stream containing hydrocarbon fractions having boiling point above 180° C. and below or equal to 370° C. and a third stream containing hydrocarbon fractions having boiling point above 370° C., wherein the overall yield of the hydrocarbons with boiling point less than or equal to 370° C. is in the range of 50 wt % to 80 wt %;

wherein said third stream obtained from the process step (vi) is fractionated and a fraction is separated having boiling point above 440° C. from said third stream; and introducing said separated fraction having boiling point above 440° C. to the process step (i);

wherein the amount of said separated fraction, recycled to the process step (i) does not exceed 50 wt % of fresh feed.

2. The process as claimed in claim 1, wherein said first catalyst and said second catalyst comprise at least one metal or compounds of metals individually selected from the group consisting of chromium, manganese, iron, cobalt, nickel, zirconium, niobium, molybdenum, tungsten, ruthenium, rhodium, tin and tantalum.

3. The process as claimed in claim 1, wherein in the process step (i) the amount of said first catalyst is in the range of 0.001 wt % to 10 wt % of said hydrocarbons; and in the process step (iv) the amount of said second catalyst is in the range of 0.01 wt % to 10 wt % of said hydrocarbons.

4. The process as claimed in claim 1, wherein in the process step (iv), the hydrocracking is carried out for a time period in the range of 30 minutes to 6 hours.

5. The process as claimed in claim 1, wherein in the process step (ii), hydrogen is produced in the first top product stream in the range of 0.2 to 17 wt % of fresh feed.

6. The process as claimed in claim 5, wherein the process further comprises separating the hydrogen produced in the first top product stream and recycling the hydrogen to the process step (i).

* * * * *